United States Patent [19]

Mathis

[11] Patent Number: 4,630,319

[45] Date of Patent: Dec. 23, 1986

[54] ARTICLE HOLDING MECHANISM FOR A GARMENT AND OTHER SURFACES

[76] Inventor: Lawrence Mathis, 1451-E Willow Lake Dr., Atlanta, Ga. 30329

[21] Appl. No.: 789,160

[22] Filed: Oct. 18, 1985

[51] Int. Cl.[4] ..... A41D 27/20

[52] U.S. Cl. ..... 2/250; 2/49 A; 2/94

[58] Field of Search ..... 211/74, 75, 81, 85; 206/557, 564; 200/1 BC; 224/158, 182, 194, 201, 202; 2/250, 102, 247, 51, 49 R, 49 A, 49, 94

[56] References Cited

U.S. PATENT DOCUMENTS

| | | | |
|---|---|---|---|
| 1,879,341 | 9/1932 | Lapham | 2/102 |
| 2,375,643 | 5/1945 | Germanotta | 206/564 X |
| 2,520,285 | 8/1950 | Olson | 2/94 |
| 2,695,712 | 11/1954 | Kolander | 206/564 |
| 2,717,391 | 9/1955 | Bracken | 2/94 |
| 2,733,845 | 2/1956 | Biro | 224/201 |
| 2,853,709 | 9/1958 | Peterson et al. | 2/51 |
| 2,995,281 | 8/1961 | Dixon | 224/201 X |
| 3,095,576 | 7/1963 | Jenter | 2/51 |

FOREIGN PATENT DOCUMENTS

| | | | |
|---|---|---|---|
| 0099107 | 6/1940 | Sweden | 2/94 |

*Primary Examiner*—Louis K. Rimrodt
*Attorney, Agent, or Firm*—Parkhurst & Oliff

[57] ABSTRACT

A novelty garment having an article holding mechanism for holding a container, allowing greater mobility of the user and providing a means for advertising a product. The article holder includes a foldable pocket-like portion with a retainer for holding an article such as a cup or beverage can. Unfolding the pocket-like portion unfolds the retainer to a stable horizontal position for reception of the cup or can. The base of the cup or can is supported by the unfolded pocket-like portion.

14 Claims, 4 Drawing Figures

ARTICLE HOLDING MECHANISM FOR A GARMENT AND OTHER SURFACES

BACKGROUND OF THE INVENTION

In recent years there has been an increase in the number of novelty garments or clothing items that also fulfill a practical purpose. For example, the novelty clothing industry has produced a hat-umbrella and several variations on the theme of incorporating a fan with an article of clothing. These items, designed primarily for use at outdoor activities such as spectator sports, are at once practical and entertaining. They are also suitable as a means of advertising a product, and frequently the logo or trademark of a company sponsoring a public event is seen in association with the novelty item.

Articles of clothing are also used to hold an article against a user's chest to keep the hands of the user free or unencumbered. For example, U.S. Pat. Nos. 2,717,391 and 1,879,341 disclose vests having pockets and/or straps for holding articles such as fishing poles and tackle.

Nevertheless, the prior art has not disclosed clothing which satisfies both the practical aim of holding an article and the entertaining/advertising aspects of novelty clothing.

SUMMARY OF THE INVENTION

A primary object of the present invention is to provide an article of clothing having a practical means for holding a container for use by the wearer of the garment.

Another object of this invention is to provide a handy means for holding a container, such as a beverage container, steady and within reach while a person is engaged in another activity such as watching or participating in spectator sports, driving an automobile or walking.

Still another object of this invention is to provide an article of clothing having means for holding a container which has an attractive means for advertising a product such as exhibiting the beverage which may be held in the inventive device.

The inventive article has a purpose satisfaction of the above stated need for a novelty garment item which can hold an article, provide improved hand mobility for the user, and serve as a means for advertising a product.

The invention attains these goals through an article holding mechanism suitable for attachment to a garment or attachment to other surfaces on which an article holding apparatus may be of use.

The article holding mechanism comprises an outer section having a first edge releasably attached to a first portion of a garment and an opposite second edge pivotably attached to a second portion of the garment for pivotal movement about the second edge. The outer section is movable to an open position in which the first edge is detached from the garment and a closed portion in which the first edge is attached to said garment. A retainer is provided and has one edge hingeably attached to the first edge of the outer section and a second edge hingeably attached to said garment at a position intermediate the first and second portions of the garment. At least one strap is provided and has one end fixed to the first portion of the garment and an opposite end fixed to the first edge of the outer section. The strap has length sufficient to permit the retainer to extend generally perpenicularly from the garment, support means are provided retaining said article in the retainer. The support means includes an aperture located in the retainer for receiving the article, and a central area of the outer section between the first and second edges. In operation, the article is received in the aperture with a base of the article being supported by the central area.

DETAILED DESCRIPTION OF A PREFERRED EMBODIMENT OF THE INVENTION

Figure 1:
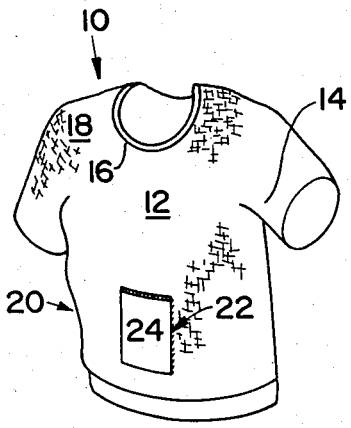
FIG. 1 is a perspective view of a T-shirt having the inventive drink holder in a closed position.

An article of clothing which embodies the present invention is illustrated in FIG. 1. For purposes of this description, the article is shown in the form of a T-shirt 10. However, the invention may be embodied in any type of garment. The T-shirt 10 is of conventional design, and includes a torso 12, short sleeves 14, neck area 16 and shoulder area 18. The torso 12 of the T-shirt 10 has a front portion 20. Affixed to the outside of the front portion 20 of the T-shirt 10 is a pocket-like portion 22.

The term pocket-like portion will hereinafter refer to the rectangular area on the front torso of the T-shirt illustrated in FIG. 1. "Pocket-like" is meant to describe only the appearance of the rectangular area for purposes of locating points of attachment for the components of the invention. It is not meant to describe or limit the function of the rectangular area as that of a pocket in the manner in which the term pocket is normally understood. Further, the pocket-like portion need not be rectangular, but is adaptable to any convenient shape as evident from the description herein.

Figure 2:
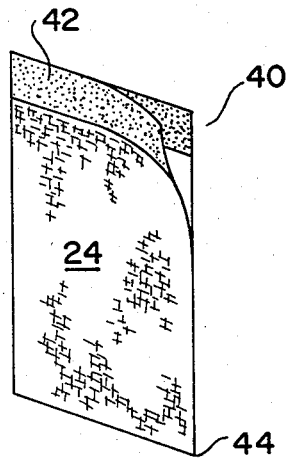
FIG. 2 is a perspective view of the pocket-like portion of the invention drink holder illustrated in FIG. 1 in the closed position.

The pocket-like portion 22 of the T-shirt 10 comprises an outer flap or section 24 which is illustrated in the closed position in FIGS. 1 and 2. Outer section 24 is releasably attached by a fastening mechanism to the top 40 of the pocket-like portion 22 of the T-shirt 10. A strip 42 along the top of the outer section 24 is made of a material capable of furnishing a weak bond to the top 40 of the pocket-like portion 22. Any material which will hold firmly when engaged but is easily unbound by a person will be suitable. For example, in the preferred embodiment, the strap 42 may be a fibrous strip releasably engaged with a fibrous hook-like strip on the top 40 of the pocket-like portion 22. These strips are commonly available under the tradename "Velcro strips". Other fasteners are available such as zippers or buttons. The description which follows, however, will refer to the fabric fastener strip for the fastener means as Velcro strips.

The outer section 24 is permanently affixed to the bottom section 44 of the pocket-like portion 22 of the T-shirt 10 in conventional fashion. For example, the outer section 24 may be sewn or glued at the line of attachment 44. The bottom section 44 functions as a hinge about which the outer section 24 pivots.

The outer section 24 may be comprised of a variety of different materials. However, the material must be flexible, strong and shrink resistant.

The outer section 24 is released from its point of attachment along the top portion 40 of the T-shirt 10 by detaching the velcro strip 42 fron the top 40 as illustrated in FIG. 2.

The outer section thus pivots along the bottom edge 44. Straps 54 are permanently fixed to the bottom edge or base 56 of the top 40 of the pocket-like portion 22. The opposite end of the straps 54 are also permanently fixed to the outer section 24 at the bottom edge 62 of the velcro strip 42. Each strap 54 is a thin, flexible, strong band of shrink resistant material and preferably is made of the same material as the outer section 24. Each strip has a fold 58 at its central portion for reasons that will be described below.

When the outer section 24 is in the closed position, attached by its velcro strip 42 to the top 40 of the pocket-like portion 22, the straps 54 are folded inside the pocket-like portion 22, and hidden from view. The strips collapse along the fold 58. However, opening of the outer section 24 permits the straps 54 to unfold and move outward away from the user's torso with the outer section 24.

The pocket-like portion 22 of the T-shirt 10 also includes a second retaining section 60. The second section 60 has one edge 74 permanently fixed to the article of clothing along an edge 74 adjacent to the bottom edge 44 of the pocket-like portion 22 of the T-shirt 10. Preferably, the edge 74 is separated from the bottom edge 44 by a distance X. The opposite edge of the second section 60 is also permanently fixed to the outer section 24 at the base 62 of the velcro strip 42. The second section 60 comprises a preferably stiff substance 76 covered with a flexible, shrink resistant material 70. The stiffness of the substance 76 for the second section 60 may be satisfied by a variety of products. Wood will suffice, but a hard plastic material or paperboard is preferred.

The second section further includes an aperture 72 centrally located in the second section and extending through the substance 76 and covering material 70. The aperture 72 may be of dimensions to suit the user. In this embodiment of the T-shirt 10, the aperture 72 is preferably a circle suitable for holding standard size containers such as beer, soda, juice or water-type can or glass commonly available.

Figure 4:
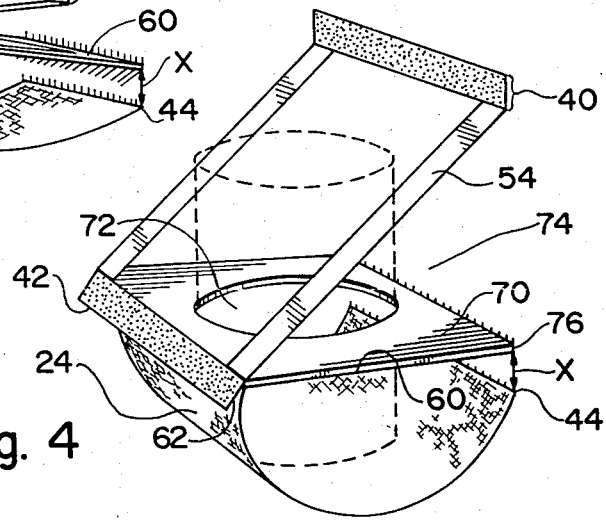
FIG. 4 is a perspective view of the pocket-like portion of FIG. 3 in the fully opened position with a container inserted therein.

When the outer section is in the open position as in FIG. 4, and the straps 54 are pulled taut, the second section 60 extends approximately perpendicularly outward from the plane of the pocket-like portion 22 of the T-shirt 10. The length of the straps 54 is thus determined by the length necessaary to be taut while simultaneously maintaining the second section 60 in a generally horizontal plane when the pocket-like portion 22 is in the opened position. In the open position, the outer section 24 extends from the first edge 74 to the edge 62 of the velcro strip 42. Since the first edge 74 is separated from the bottom edge 44 by the distance X, the outer section 24 is longer than the second section 60, thereby causing the outer section to flap or curve downwardly as it extends between the edges. A beverage container, preferably having a diameter slightly less than that of the aperture 72, is then inserted into the aperture. The beverage container will be supported at its base by the outer section 24, as illustrated in FIG. 4. The container will be stabilized in its upright position by the peripheral wall of the aperture 72. The user's hands are unencumbered while the beverage container is supported.

When not in use, the container is removed from the aperture 72 and the pocket-like section 22 is moved to the closed position. Closing the outer section 24 forces the second section 60 to pivot on its first edge 76. Simultaneously, strap 54 folds along fold line 58. In its closed position, the open section 24 maintains the second section 60 and strips 54 against the torso of the user.

The pocket-like portion 22 may be provided in other sections of the article of clothing and on other articles such as pants or jackets. Further, the open section 24 may provide an area for a logo or other advertisement visible in the open and closed position of the drink holder. In addition, the portion B of the clothing behind the outer section 24 (in the closed position) will be visible when opened and thus may be utilized as a logo area.

Figure 3:
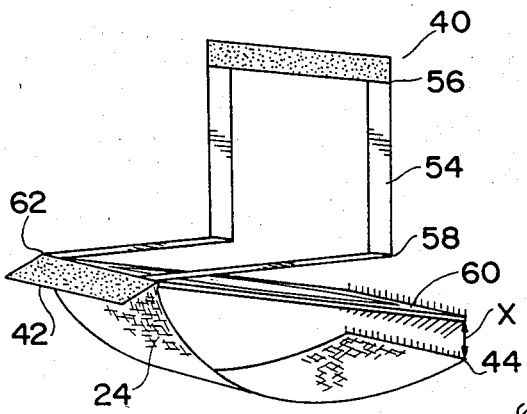
FIG. 3 is a perspective view of the pocket-like portion when in a partially opened position.

In FIG. 3, B represents background, or the portion of the garment between the bottom edge or base 56 of the top 40 of the pocket-like portion 22 and the bottom edge 44 of the pocket-like portion 22. The portion B is visible whenever the outer section 24 is in either a partially open position (FIG. 3) or a fully open position (FIG. 4). In FIGS. 1 and 2, the portion B is obscured behind the outer section 24.

When the invention is adapted for use on other than a garment to be worn, the portion B will be visible as the surface on which the container holding mechanism is attached when the mechanism is partially or fully open. The same portions of the invention which will attach to a garment namely top edge 40, bottom edge 44, and first edge 76 may also be adapted for attachment to other items. A wall, door, or the interior of a moving vehicle are possible places of application for the invention. An adhesive may be used to attach the edges on any surface to which the drink holder is to be attached. A releasably attachable material such as that suggested for sections 40 and 42 may also be used.

In this embodiment, the invention is portable, simply installed and provides the same advantages as when attached to a garment. The invention provides increased mobility to the user, a steady, secure means of holding a container, and a means for displaying a logo or an ad.

The principles, preferred embodiments and modes of operation of the present invention have been described in the foregoing specification. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not as limiting to the scope and spirit of the invention as set forth in the appended claims.

What is claimed is:

1. A garment having an article holding mechanism comprising:

an outer section having a first edge releasably attached to a first portion of said garment and an opposite second edge pivotably attached to a second portion of said garment for pivotal movement about said second edges, said outer section being movable to an open position in which said first edge is detached from said garment and a closed position in which said first edge is attached to said garment, a retainer having one edge hingably attached to said first edge of said outer section and a second edge hingably attached to said garment at a position intermediate said first and second portions of said garment;

at least one strap having one end fixed to said first portion of said garment and an opposite end fixed to said first edge of said outer section, said strap having a length sufficient to permit said retainer to extend generally perpendicularly from said garment, said strap being foldably disposed between said outer section and said garment when said first edge of said outer section is fixed to said first portion of said garment; and support means for retaining said article in said retainer, said support means including an aperture located in said retainer for receiving said article, and a central area of said outer section between said first and second edges, said article being received in said aperture with a base of said article being supported by said central area.

2. The garment as set forth in claim 1, wherein said second retainer is a stiff substance.

3. The garment as set forth in claim 2, wherein the stiff substance is plastic.

4. The garment as set forth in claim 1, wherein said outer section and straps are comprised of flexible sheet material.

5. The garment as set forth in claim 1, wherein said outer section and straps are made of a shrink resistant material.

6. The garment of claim 1, wherein said retainer is wrapped in a fabric.

7. The garment of claim 1, wherein said garment is a shirt.

8. The garment of claim 1, wherein said first and second portions of said garment are located on a front torso section of said shirt.

9. The garment of claim 1 further comprising means for releasably attaching said first edge to said first portion of said garment.

10. The garment of claim 1, wherein said means for releasably attaching includes a first fabric strip on said first edge of said outer section and a second hook fabric strip on a first portion of said garment said first and second strips being releasably attached to each other.

11. The garment of claim 1, wherein said retainer has a length shorter than the length of said outer section.

12. The garment of claim 1, wherein said aperture has a circular shape with a diameter at least as great as a diameter of said article.

13. A container holding apparatus adapted for attachment to a surface, comprising:

an outer section having a first edge releasably attached to a first portion of said surface and an opposite second edge pivotably attached to a second portion of said surface for pivotal movement about said second edge, said outer section being movable to an open position in which said first edge is detached from said surface and a closed position in which said first edge is attached to said surface;

a retainer having one edge hingably attached to said first edge of said outer section and a second edge hingably attached to said surface at a position intermediate said first and second potions of said surface;

at least one strap having one end fixed to said first portion of said surface and an opposite end fixed to said first edge of said outer section, said strap having a length sufficient to permit said retainer to extend generally perpendicularly from said surface, said strap being foldably disposed between said outer section and said surface when said first edge of said outer section is fixed to said first portion of said surface; and support means for retaining said article in said retainer, said support means including an aperture located in said retainer for receiving said article, and a central area of said outer section between said first and second edges, said article being received in said aperture with a base of said article being supported by said central area.

14. The container holding apparatus of claim 13 wherein a central portion of the surface between the first and second portion is unobscured by said outer section in the open position.

* * * * *